US006495111B2

(12) United States Patent
Kurth

(10) Patent No.: US 6,495,111 B2
(45) Date of Patent: Dec. 17, 2002

(54) STERILE TUNNEL OR TUBE FOR ASEPTICALLY OPERATING PACKING MACHINES

(75) Inventor: Gunter Kurth, Ranstadt (DE)

(73) Assignee: Hassia Verpackungsmaschinen GmbH, Ranstadt (DE)

( * ) Notice: Subject to any disclaimer, the term of this patent is extended or adjusted under 35 U.S.C. 154(b) by 0 days.

(21) Appl. No.: 09/772,471

(22) Filed: Jan. 30, 2001

(65) Prior Publication Data

US 2001/0010805 A1 Aug. 2, 2001

(30) Foreign Application Priority Data

Jan. 31, 2000 (DE) ..... 100 04 076

(51) Int. Cl.[7] ..... A61L 2/00; B65B 31/02; B65B 31/04; B65B 55/00; B65B 31/00

(52) U.S. Cl. ..... 422/300; 422/1; 422/292; 422/300; 422/305; 53/428; 53/432; 53/111 R; 53/510

(58) Field of Search ..... 422/1, 120, 292, 422/300, 305; 53/428, 432, 111 R, 510

(56) References Cited

U.S. PATENT DOCUMENTS 3,800,947 A * 4/1974 Smith ..... 210/117
3,846,518 A * 11/1974 McPhee ..... 128/188
4,068,659 A * 1/1978 Moorehead ..... 128/214.4
4,068,660 A * 1/1978 Beck ..... 128/214.4
4,332,250 A * 6/1982 Behney ..... 128/239
5,596,988 A * 1/1997 Markle et al. ..... 128/635

FOREIGN PATENT DOCUMENTS

EP 0 727 357 1/1996

* cited by examiner

*Primary Examiner*—Robert J. Warden, Sr.
*Assistant Examiner*—Imad Soubra
(74) *Attorney, Agent, or Firm*—Collard & Roe, P.C.

(57) ABSTRACT

The invention is concerned with so-called sterile tunnels or tubes on aseptically operating packing machines. During operation, sterile air und during the pre-sterilizing phase, sterilizing fluid can flow through the telescopic tubular sealants provided on sterile tunnels or tubes of this type for the passage of mounting linkages of working elements disposed in the sterile chamber of the tunnel. To safely strike and destroy, during the pre-sterilization of the sterile tunnel, all germs contained in the labyrinth-type telescopic tubular sealant, discharge openings are provided in the upper part of the telescopic tubular sealant.

10 Claims, 5 Drawing Sheets

STERILE TUNNEL OR TUBE FOR ASEPTICALLY OPERATING PACKING MACHINES

BACKGROUND OF THE INVENTION

1. Field of the Invention

The present invention is concerned with aseptically operating packing machines and, in particular, relates to the design of the housing confining the sterile chamber of machines of this type, through which the web of packing material to be processed is guided under sterile conditions, when passed, for example, through preheating, moulding and filling stations.

2. Description of Prior Art

Irrespective of whether packing machines of this type are deep-drawing or tubular bag-type producing machines, the working elements of the afore-mentioned stations located in the sterile chamber will have to be operated externally, with the adjusting linkage thereof extending through the housing wall within a telescopic tube sealant, wherein the upper telescopic tube embraces the bottom telescopic tube seated stationarily on the housing, and is in communication with the appertaining drive.

Housings furnished with a telescopic tubular sealant of this type, hereinafter referred to as sterile tunnels or tubes, have been disclosed, for example, by European Patent Application 0727357. In this respect, a difference will have to be made between the normal operation of the packing machine (which in the afore-mentioned European Patent Application, is a deep-drawing packing machine) and the so-called pre-sterilization process always to be carried out following any interruption of operation. The said pre-sterilization is not effected by the sterile air permanently supplied during operation, but rather by another suitable sterilizing medium, such as a hydrogen peroxide finely divided within a corresponding fluid. In addition to areas other than those provided herefore, a minor part of the sterile air also during normal operation is discharged from the sterile tube through the telescopic tube sealant forming a discharge labyrinth for the sterile air, thereby also preventing the ingress of germs into the said telescopic tubular sealants from occurring. The same applies to sterilizing media supplied during the pre-sterilizing phase. The said sterilization is intended to safely eliminate the development of germs formed after a certain period of standstill of the packing machine concerned, within the sterile tunnel, the telescopic tubular sealant and all working elements contained therein. However, despite intensive pre-sterilizing efforts, germs consistently continued to develop in the sterile tube, even though to a minor extent. This fact which, initially, was inexplicable, virtually was found to be due to the telescopic tubular sealant which compared to other sealing types (bellow sealings, membrane sealings, vapor barriers or the like) is per se the most favourable one, because, on the one hand, the upper inner area of the upper telescopic tube, during the pre-sterilizing process, was suspected to be not entirely struck by the sterilizing fluid flowing therethrough and, on the other hand maintaining the telescopic tubular sealant which, per se is a satisfactory option, would prevent a solution to that problem from being attained, since the inverted cup shape of the telescopic tube was and is an inevitable condition.

SUMMARY OF THE INVENTION

It is an object of the present invention to so design the telescopic tube sealant on the sterile tubes of aseptically operating packing machines that during the pre-sterilizing phase, germs grown in the telescopic tubular sealant be safely struck and destroyed by the sterilizing fluid flowing therethrough.

Another object of the invention is to guide the flowing sterilizing fluid by simple, structural means through the labyrinth of the telescopic tubular sealant so as to strike all areas normally not or not completely struck.

In addition, it is an object of the invention to design the flow path through the labyrinth in such a manner that favourable conditions of flow are created.

This and other objects of the invention have been achieved in accordance with the invention in that an arrangement of the type described in the introduction part hereto was given the characteristic that apertures be circumferentially uniformly distributed in the upper area of the top telescopic tube for discharging the sterilizing fluid flowing from the sterile tunnel into the telescopic tube sealant.

This solution which is both simple and elegant promptly yielded the desired result, i.e. no germ formation otherwise occurred has developed any longer. Owing to the apertures now provided on the upper telescopic tube, an additional passageway for discharging the sterilizing fluid from the upper inner area of the top telescopic tube has been provided, which otherwise could only flow off through the annular gap between the upper and lower telescopic tubes, leaving, however, the upper interior area out of reach of the sterilizing fluid, i.e. germs formed there were not struck by the sterilizing fluid flowing therethrough.

In sterile tunnels wherein the upper telescopic tube is provided with a flange secured thereby to a carrier plate in communication with the associated drive (which is the standard design of telescopic tubular sealants of this type), the apertures confined by the carrier plate or the flange, are simply arranged within the said flange or carrier plate.

Another form of embodiment of the invention resides in that the top telescopic tube, at the upper end thereof, is closed by a plate in communication with the drive, with the said plate being provided with apertures. Moreover, the said apertures, in cross-section, can be of a slot-type configuration and in width can be so dimensioned that bridges are left between the slots that are narrower than the slot width.

To insure that the off-flowing sterilizing fluid does not take the path of least resistance through the annular gap between the upper and the lower telescopic tube, the apertures on the upper telescopic tube, in addition, are so dimensioned that the general cross-section thereof substantially corresponds to the one of the annular gap.

In conclusion, in the practice of the invention, provision can also be made for favourable flow conditions on the upper, inner limitation of the upper telescopic tube in that even minimum "dead water corners" be avoided.

The above and other objects, features and advantages of the invention will become more apparent, and the invention itself will be understood, from the following description and appended claims, taken in connection with the attached drawings.

DESCRIPTION OF PREFERRED FORMS OF EMBODIMENT

Figure 1:
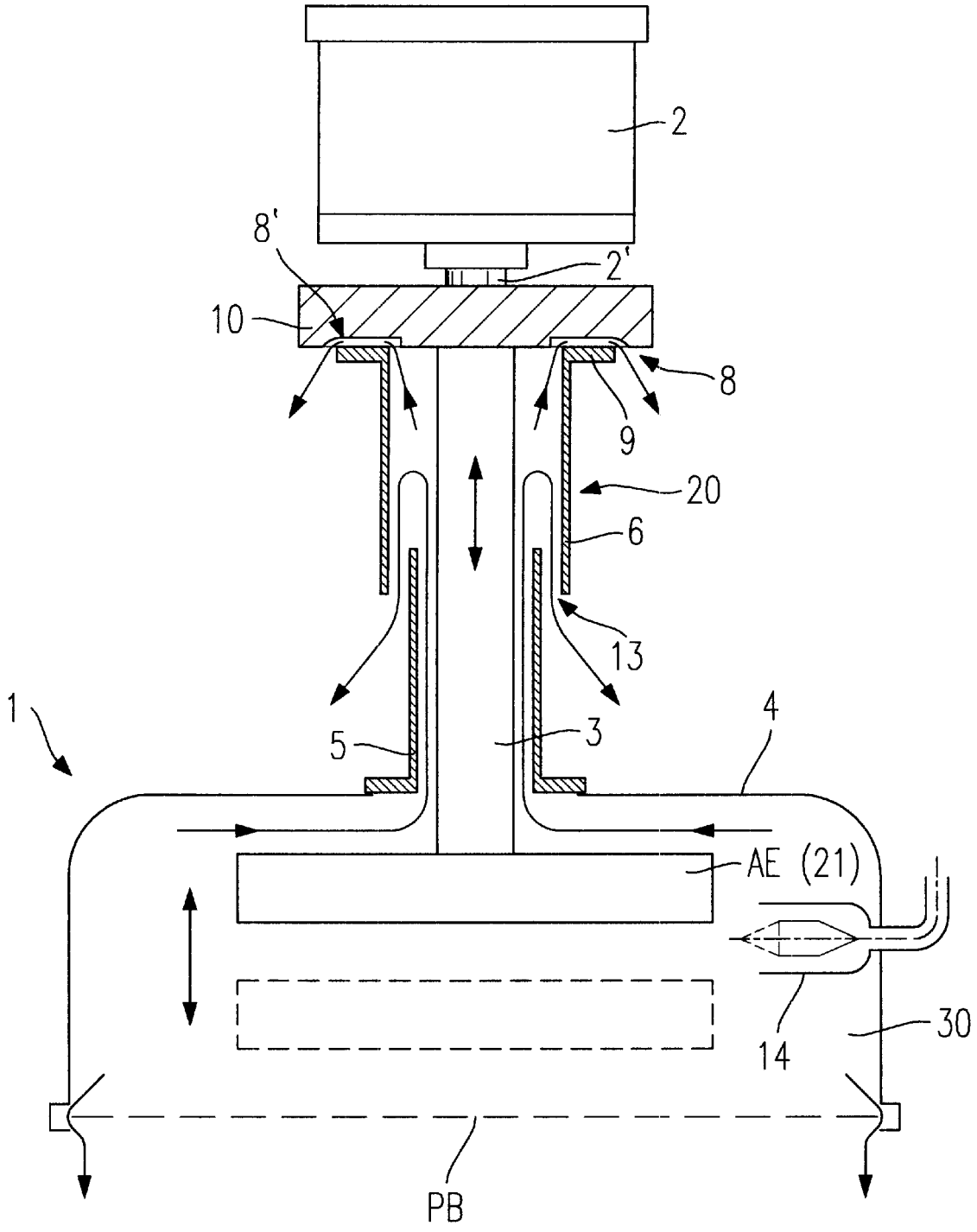
FIG. 1 schematically shows, partly as a sectional and partly as a front view, the sterile tunnel along with a telescopic tubular sealant mounted thereon, taken along the line I—I in FIG. 8

Referring to FIG. 1, the sterile tunnel 1 confining the sterile chamber 30 is composed of the tunnel 1 itself containing a gaseous sterile fluid (sterile air) under a slight pressure (in the form of embodiment, the tunnel 1 is a so-called semi-tunnel), comprising drives 2 mounted thereon for the working elements located in the tunnel, whose adjusting linkages 3 respectively pass through the tunnel wall 4 within a telescopic tubular sealant 20, with the upper telescopic tube 6 embracing the bottom telescopic tube 5 stationarily seated on the tunnel 1 and being in communication with the associated drive 2.

Figure 8:
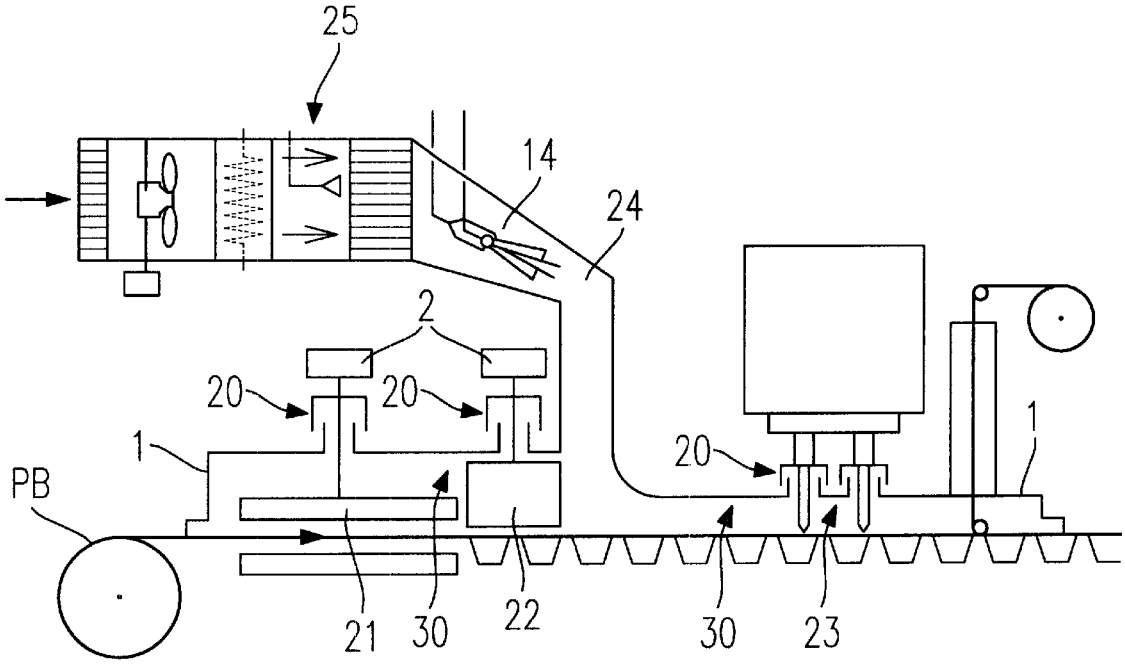
FIG. 8 is a side view of the structural principle of an aseptically operating deep-drawing machine.
Figure 9:
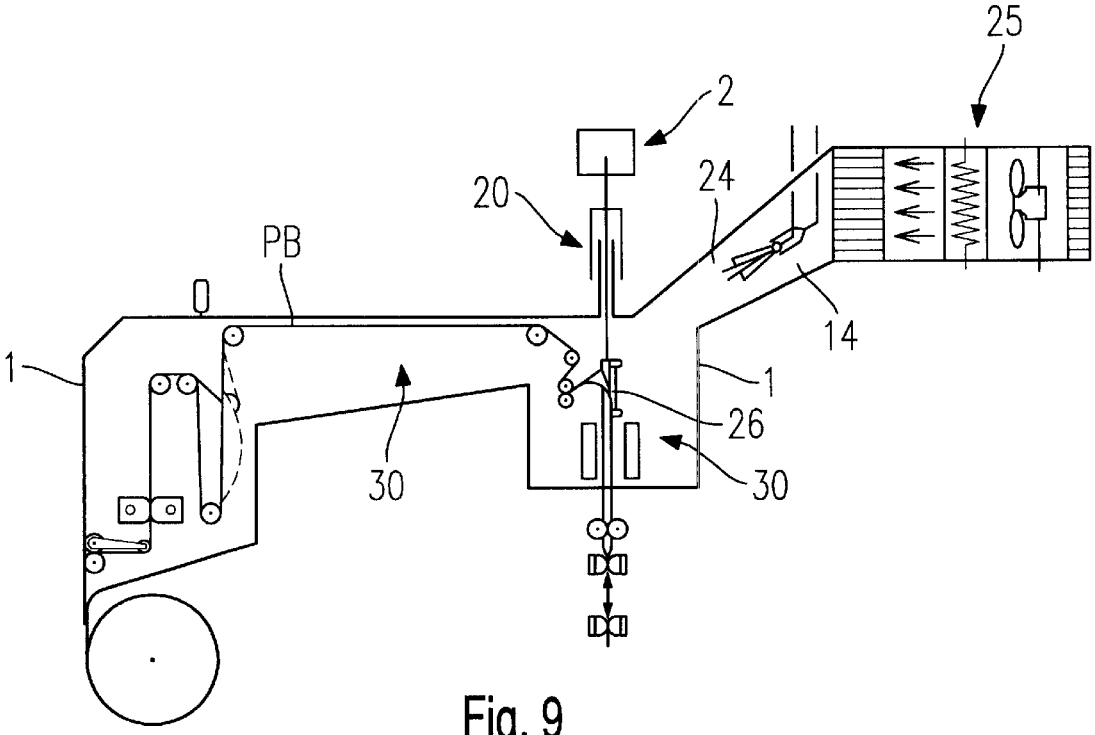
FIG. 9 schematically shows a side view of the structural principle of an aseptically operating tubular bag producing machine.

The working elements AE only schematically shown in FIG. 1, that are to be adjusted over the web of packing material PB in accordance with the working cycle, in a deep-drawing packing machine are, for example, preheating plates 21, deep-drawing tools 22, loading tubes 23 or the like of the type as schematically shown in FIGS. 8 and 9, with FIG. 9 showing the principle of a tubular bag packing machine wherein, for example, the loading tube is adjusted.

The designs of the connection of the linkage 3 to the set rod 2' of the drive 2, wherein a carrier plate 10 is inserted, as shown in the examples of embodiment according to FIGS. 1,2 and 4,5 are demonstrated by way of example only, referring in that form to the adjusting mechanism for the preheating plates 21.

For introducing the sterilizing fluid for pre-sterilizing the sterile tunnel 1, one or more supply nozzles 14 are arranged on the sterile tunnel 1, as schematically shown in FIG. 1. In the examples of embodiment for the deep-drawing and tubular bag machines according to FIGS. 8 and 9, respectively, only one supply nozzle 14 is provided in the sterile air supply passageway 24 behind a means 25 for generating sterile air.

In respect of a sterile tunnel 1 of this type provision has been made, in the practice of the present invention, that apertures 8 for the discharge of the sterilizing fluid from the tunnel 1 be circumferentially uniformly distributed in the upwardly closed upper area 7 of the top telescopic tube 6.

Figure 2:
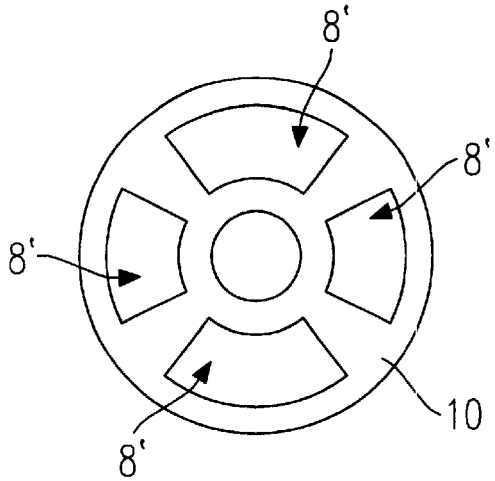
FIG. 2 schematically shows a bottom plan view of a carrier plate for the upper telescopic tube according to FIG. 1.

If, as mentioned in the afore-going, the upper telescopic tube 6 is provided with a flange 9, and if the same is fixed, through the said flange 9, to the carrier plate 10 in communication with the drive 2, the apertures 8 confined by the carrier plate 10 or the flange 9, are arranged within the latter of which FIGS. 1,2 show the embodiment according to which the apertures 8 are cut on the bottom side of the carrier plate 10 in the form of wide slots 8' as illustrated in FIG. 2. However, slots 8' of this type also could be cut in flange 9 in which case they were upwardly confined by carrier plate 10 as in the forms of embodiment according to FIGS. 4,5.

Figure 5:
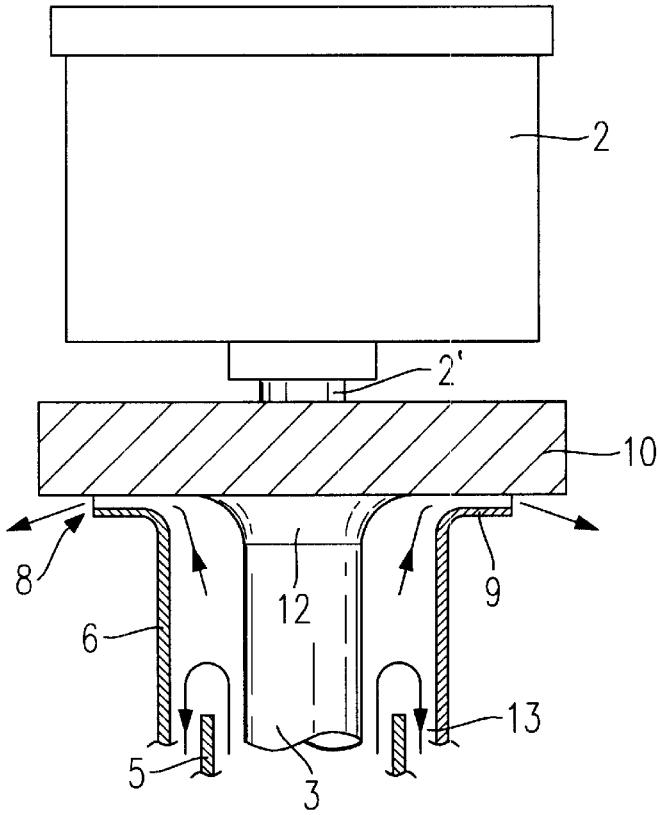

The embodiment according to FIG. 5 shows a special feature that can also be integrated in the other forms of embodiment, namely to provide (for reasons set out in the introductory part) in the upper area within the interior of the top telescopic tube 6, a concave flow guiding structure 12 leading to the apertures 8, insuring avoidance even of cornered pockets preventing germs from being reached by the sterilizing fluid. The said concave flow guide 12, preferably, is designed as part of the said linkage. In view of the said flow guide 12, the said upper tube 6 is provided with a flange 9 which, conforming to the said concave flow guide 12, is formed with a convex curvature passing to the upper tube 6.

Figure 6:
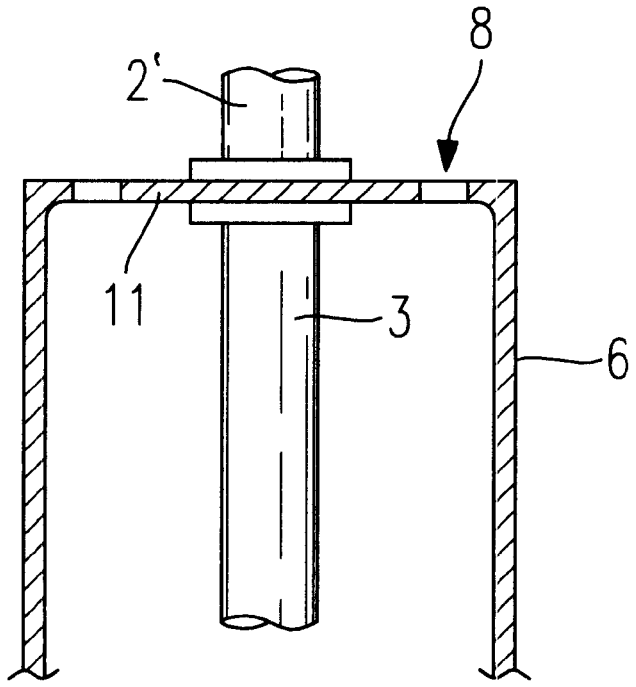
FIG. 6 is a sectional view of a special form of embodiment.
Figure 7:
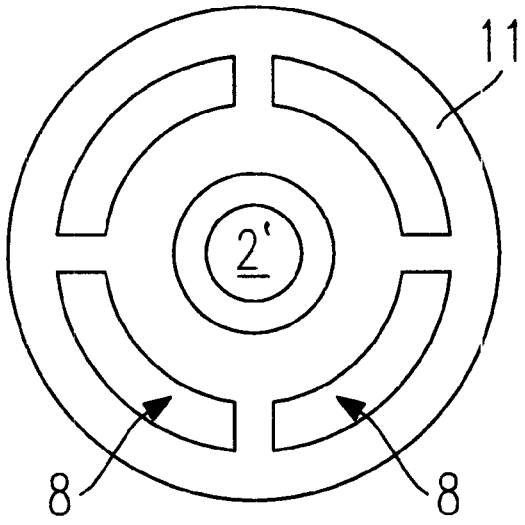
FIG. 7 is a top plan view of the upper telescopic tube according to FIG. 6.

The apertures 8, irrespective of whether they are slotted openings 8' or holes of other cross-sectional shapes, for the same reasons set out in the introductory part, are so dimensioned that the general cross-section thereof substantially corresponds to the one of the annular gap 13 confined by the telescopic tubes 5, 6. In particular, in case the packing machine should be of the single-row type with no plurality of linkages 3 arranged in side-by-side relationship on a carrier plate 10 of a corresponding length in a direction transverse to the web of packing material PB as shown in FIG. 1 in broken lines only, the upper telescopic tube 6 at the upper end thereof could be closed by a plate 11 in communication with the drive 2 and the said plate 11 could be provided with apertures 8 as shown in FIGS. 6,7, with the openings 8 simply branching upwardly, as shown in the top plan view according to FIG. 7.

Figure 3:
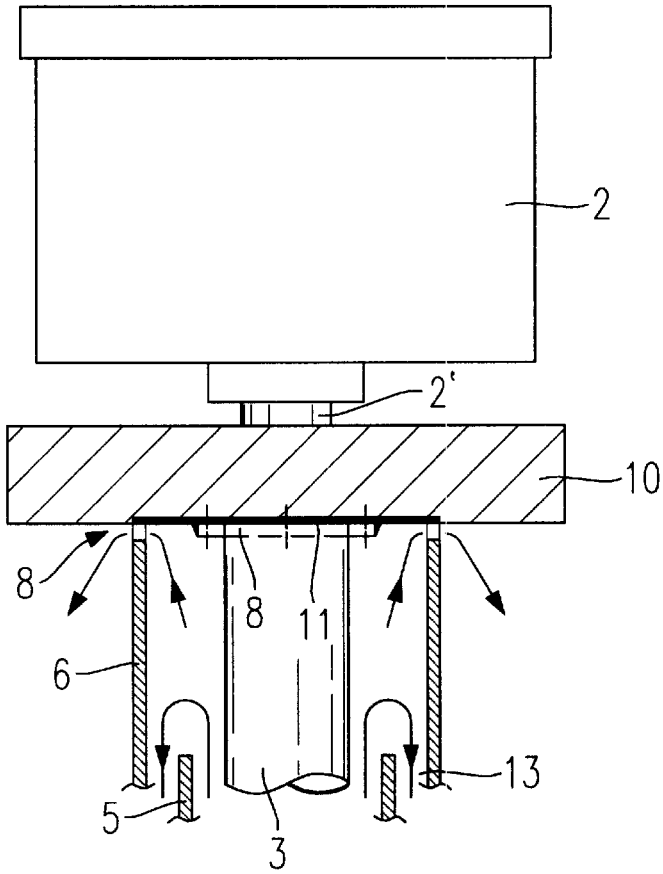
FIGS. 3–5 show additional forms of embodiment of the telescopic sealing.
Figure 4:
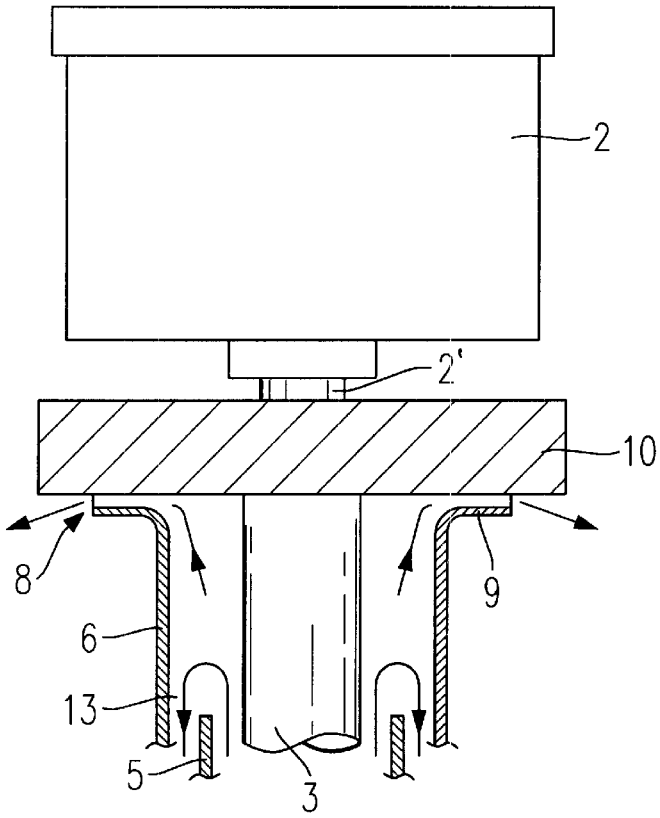

A cup-shaped design of the upper telescopic tube 6 of the afore-described type is also shown by the embodiment according to FIG. 3. However, in that case, in view of the connection to the carrier plate 10, the apertures 8 are located in the tubular wall of the upper telescopic tube directly underneath the "cup bottom" or the plate 11, respectively.

Any changes may be made to the construction of the device and the arrangement of parts from those described without departing from the spirit of the invention, provided, however, that such changes fall within the scope of the claims appended hereto.

What is claimed is:

1. A sterile tunnel for an aseptically operating packing machine, wherein the packing machine comprises (a) a housing confining a sterile chamber for a web of packing material passing through the sterile chamber, and (b) working elements arranged in the sterile chamber for working on the web of packing material and connected by linkages to drive means arranged outside the housing, and the sterile tunnel comprises (c) a telescopic tubular seal surrounding each linkage, the telescoping tubular seal comprising (1) a lower tube stationarily mounted on the housing, (2) an upper tube embracing the lower tube and being movable in relation thereto, the lower and upper tubes defining an annular gap therebetween, and (3) an upper closure connecting an upper portion of the upper tube to the drive means, the upper closure having circumferentially uniformly distributed apertures permitting a gaseous sterilizing fluid flowing through the telescopic tubular seal to be discharged therethrough.

2. The sterile tunnel of claim 1, wherein the upper closure comprises a flange at the upper portion of the upper tube and a carrier plate for the drive means, the flange being secured to the carrier plate, and wherein the apertures are defined between the flange and the carrier plate.

3. The sterile tunnel of claim 2, wherein the apertures are provided in the flange.

4. The sterile tunnel of claim 2, wherein the apertures are provided in the carrier plate.

5. The sterile tunnel of claim 1, wherein the upper closure comprises a plate connected to the drive means and closing the upper portion of the upper tube, and wherein the plate has said apertures.

6. The sterile tunnel of claim 1, wherein the apertures have a slot-shaped cross section.

7. The sterile tunnel of claim 1, further comprising a concave flow guide for guiding the gaseous sterilizing fluid to the apertures, the concave flow guide being arranged in the upper portion of the upper tube.

8. The sterile tunnel of claim 7, wherein the concave flow guide is part of the linkage.

9. The sterile tunnel of claim 7, wherein the upper closure comprises a flange at the upper portion of the upper tube, and the flange has a convex curvature conforming to the concave flow guide.

10. The sterile tunnel of claim 1, wherein the total cross section of the apertures substantially corresponds to the cross section of the annular gap.

* * * * *